US010193254B2

(12) United States Patent
Katano et al.

(10) Patent No.: US 10,193,254 B2
(45) Date of Patent: Jan. 29, 2019

(54) CONNECTOR ASSEMBLY AND CONNECTOR

(71) Applicant: Tyco Electronics Japan G.K., Kanagawa (JP)

(72) Inventors: Tetsuya Katano, Kanagawa (JP); Hiroshi Shirai, Kanagawa (JP); Takeshi Kimura, Kangawa (JP); Akira Kubo, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 9 days.

(21) Appl. No.: 14/667,104

(22) Filed: Mar. 24, 2015

(65) Prior Publication Data

US 2015/0270631 A1 Sep. 24, 2015

(30) Foreign Application Priority Data

Mar. 24, 2014 (JP) ..... 2014-059751

(51) Int. Cl.

*H01R 12/79* (2011.01)
*H01R 12/77* (2011.01)
*H01R 13/627* (2006.01)

(52) U.S. Cl.

CPC ..... *H01R 12/774* (2013.01); *H01R 13/6275* (2013.01)

(58) Field of Classification Search

CPC ..... H01R 13/6275; H01R 13/6271; H01R 23/701; H01R 9/0515; H01R 12/716; H01R 12/79; H01R 12/57; H01R 12/75; H01R 12/91; H01R 13/05

USPC ..... 439/329, 816, 352, 357, 328

See application file for complete search history.

(56) References Cited

U.S. PATENT DOCUMENTS

| | | | | |
|---|---|---|---|---|
| 5,791,932 | A | 8/1998 | Hasenfratz | |
| 6,869,301 | B2 | 3/2005 | Shimizu et al. | |
| 8,408,931 | B2 * | 4/2013 | Sato | H01R 12/7052 439/357 |
| 8,647,141 | B2 * | 2/2014 | Lee | H01R 13/639 439/372 |
| 9,153,892 | B2 * | 10/2015 | Tanaka | H01R 12/7052 |
| 9,240,654 | B2 * | 1/2016 | Takemoto | H01R 12/7029 |
| 9,257,766 | B2 * | 2/2016 | Takemoto | H01R 12/716 |
| 9,281,597 | B2 * | 3/2016 | Hashiguchi | H01R 13/24 |

(Continued)

FOREIGN PATENT DOCUMENTS

| | | | |
|---|---|---|---|
| CN | 1532995 | A | 9/2004 |
| JP | 725588 | U | 5/1995 |

(Continued)

OTHER PUBLICATIONS

Abstract of JP2008108499, dated May 8, 2008, 2 pages.
Japanese Office Action, dated Aug. 29, 2017, 4 pages.
Chinese Office Action, dated Sep. 3, 2018, 7 pages.

*Primary Examiner* — Amy Cohen Johnson
*Assistant Examiner* — Matthew T Dzierzynski
(74) *Attorney, Agent, or Firm* — Barley Snyder

(57) ABSTRACT

A connector assembly is provided with a first connector and a second connector. The first connector includes a housing and a lock spring arranged at an end portion of the housing. The lock spring includes a pair of arms extending parallel to a planar side of the housing. The second connector includes a catch to engage the lock spring by flexing the pair of arms away each other.

15 Claims, 5 Drawing Sheets

(56) References Cited

U.S. PATENT DOCUMENTS

| | | | | |
|---|---|---|---|---|
| 9,620,874 | B2 * | 4/2017 | Takemoto | H01R 12/716 |
| 2011/0151708 | A1 * | 6/2011 | Kaneko | H01R 13/65802 439/404 |
| 2014/0378007 | A1 * | 12/2014 | Miyazaki | H01R 12/716 439/816 |
| 2015/0207244 | A1 * | 7/2015 | Urano | H01R 13/6275 439/83 |

FOREIGN PATENT DOCUMENTS

| | | | |
|---|---|---|---|
| JP | H0935812 | A | 2/1997 |
| JP | 10189145 | A | 7/1998 |
| JP | 52107385 | | 2/2003 |
| JP | 200511567 | A | 1/2005 |
| JP | 2008108499 | A | 5/2008 |
| JP | 2010177003 | A | 8/2010 |

* cited by examiner (C)

CONNECTOR ASSEMBLY AND CONNECTOR

CROSS-REFERENCE TO RELATED APPLICATIONS

This application claims the benefit of the filing date under 35 U.S.C. § 119(a)-(d) of Japanese Patent Application No. 2014-059751, filed Mar. 24, 2014.

FIELD OF THE INVENTION

The invention relates to a connector assembly and, more particularly, to a connector assembly having a first connector and a second connector.

BACKGROUND

Board-mounting type connectors for connecting a flexible printed circuit (FPC) onto a circuit printed board are generally known. There has been a need to reduce the height of such known connectors, as well as a need for these known connectors to have a locking mechanism capable of being easily unlocked if necessary.

JP 2010-177003 A discloses a known connector having a lock mechanism having a lock spring with a circular cross-section. Locking and unlocking are performed by utilizing an elastic deformation of the lock spring. While the lock mechanism does not take up space for locking, its design is unsuitable for a connector having reduced height for a board-mounting type connector or the like.

SUMMARY

In view of the above circumstances, an object of the invention, among others, is to provide a connector assembly provided with a lock mechanism which is suitable for a connector with a reduced height, and is securely locked and is unlocked easily if necessary, and a connector constituting the connector assembly.

Accordingly, a connector assembly is provided with a first connector and a second connector. The first connector includes a housing and a lock spring arranged at an end portion of the housing. The lock spring includes a pair of arms extending parallel to a planar side of the housing. The second connector includes a catch to engage the lock spring by flexing the pair of arms away each other.

BRIEF DESCRIPTION OF THE DRAWINGS

The invention will be explained in greater detail with reference to embodiments, referring to the appended drawings, in which.

DETAILED DESCRIPTION OF THE EMBODIMENT(S)

Embodiments of the present invention will be described below with reference to the Figures.

Figure 1:
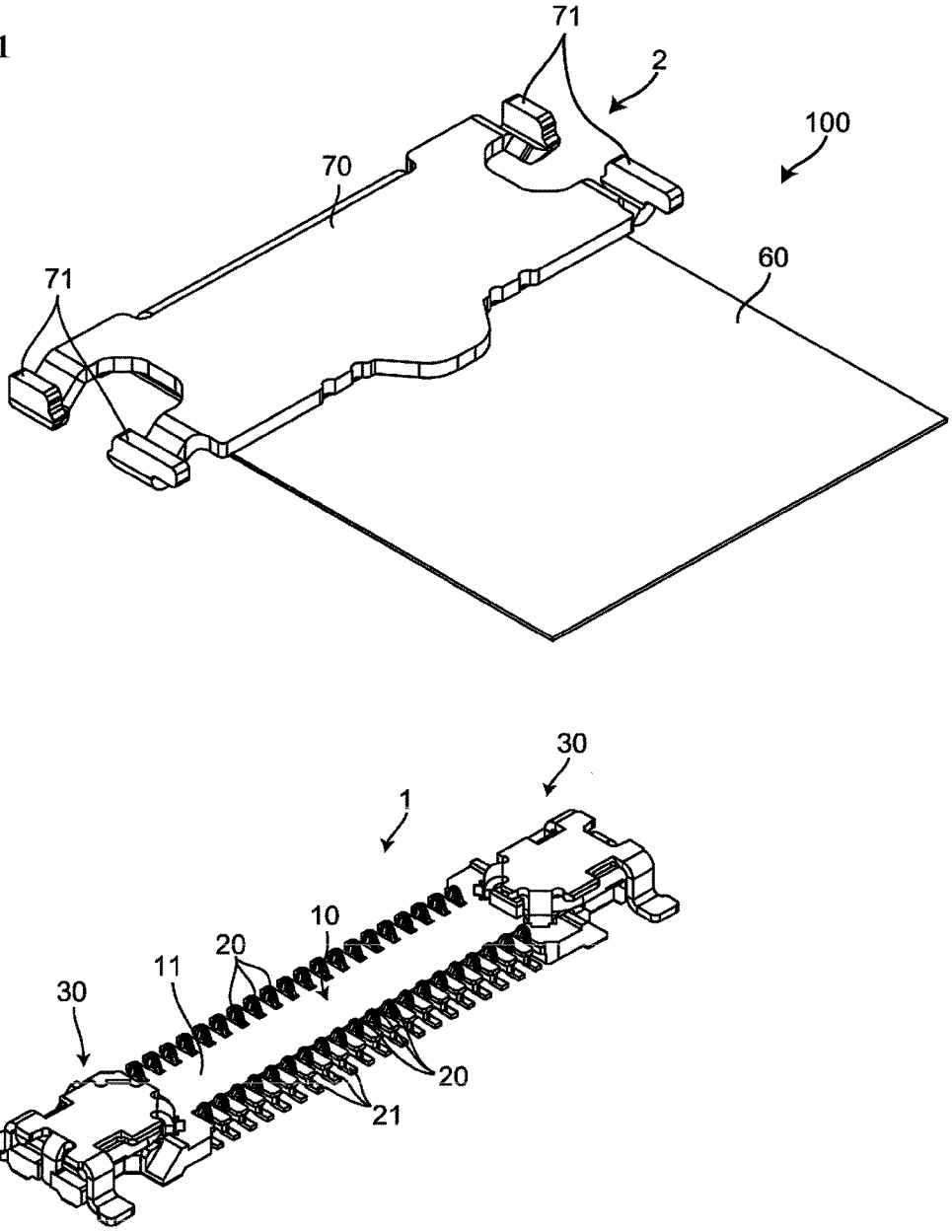
FIG. 1 is an exploded perspective view showing a first connector and a second connector of a connector assembly according to invention.

With respect to FIG. 1, a connector assembly 100 is shown with a first connector 1 and a second connector 2.

The first connector 1 includes a housing 10 with an approximately rectangular parallelepiped shape and a plurality of contacts 20 supported by the housing 10 and arranged in two rows. The housing 10 has a relatively broad mating side 11. The mating side 11 may function as a connection face for the first connector 1. Each contact 20 has a solder portion 21 to be soldered to a surface on a circuit board (not shown). Further, the first connector 1 includes lock portions 30 at both ends of the housing 10. Details of the lock portion 30 will be described later.

In the embodiment shown, the second connector 2 includes a flexible printed circuit (hereinafter, called "FPC") 60 and a metal shell 70 secured to one end of the FPC 60. The FPC 60 is actually longer than what is shown in FIG. 1. This is because only one end portion of the FPC 60 attached to the metal shell 70 is shown. Conductor pads (not shown) coming in contact with the respective contacts 20 are provided on a lower face (a face facing the first connector 1 side) of a portion of the FPC 60 covered with the metal shell 70 at positions corresponding to the plurality of contacts 20 arranged in the first connector 1.

Figure 2:
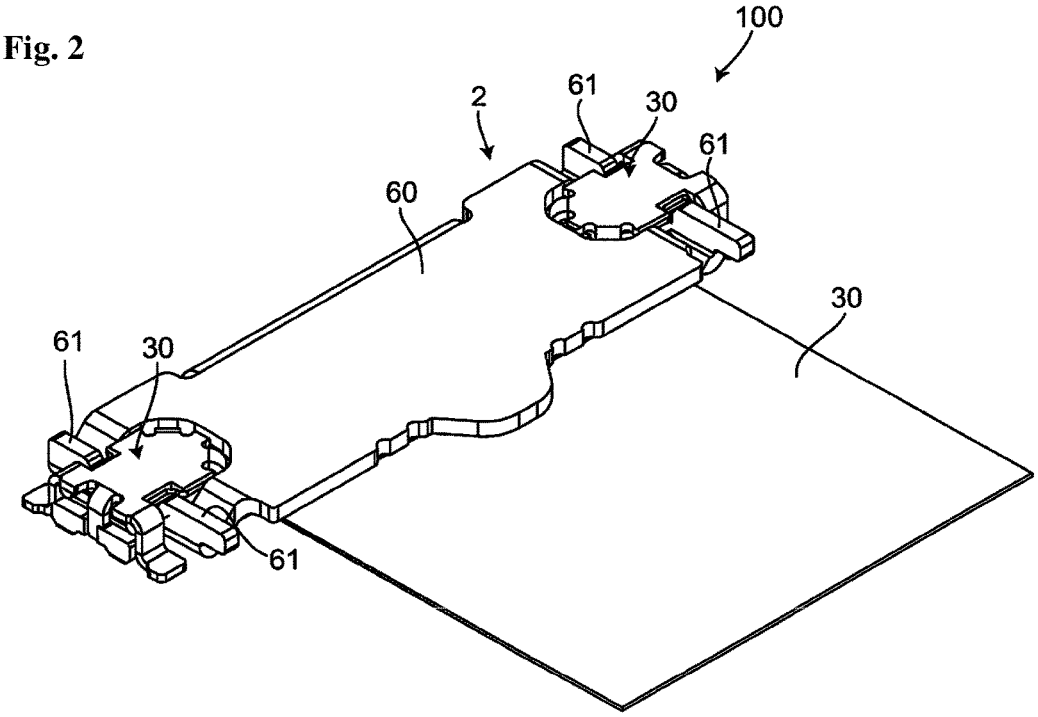
FIG. 2 is a perspective view showing the second connector secured to the first connector shown in FIG. 1.

Catches 71 are provided at both ends of the metal shell 70 of the second connector 2. The catches 71 are provided to catch the lock portions 30 of the first connector 1, such that the second connector 2 is stacked on the first connector 1, so that the second connector 2 is mated with the first connector 1, as shown in FIG. 2. Upon connection, the conductor pads (not shown) on the back face of the FPC 60 come in contact with the respective contact 20, so that wirings on the FPC 60 are electrically connected to a circuit on the circuit board (not shown) using the conductor pads and the contacts 20.

Figure 3:
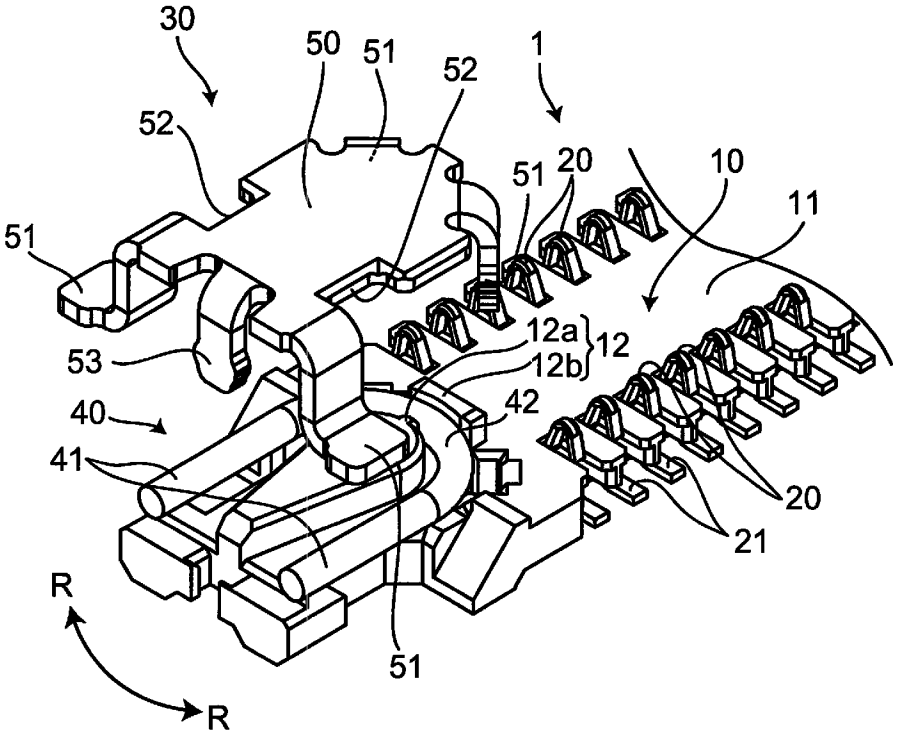
FIG. 3 is an exploded perspective view of a lock of the first connector.

With respect to FIG. 3, the lock portion 30 will be described and includes a lock spring 40 and a reinforcement fitting 50. The lock spring 40 is one wire material made of a piano wire, a stainless steel or the like and has two arms 41 extending approximately in parallel to each other. The lock spring 40 of the embodiment has a connecting portion 42 connecting one end portions of the two arms 41, and it is a metal member bent in an approximately U shape as a whole. The lock spring 40 is arranged on the mating side 11 of the housing 10 in such a way that it extends parallel to the mating side 11 facing to the second connector 2. Here, the housing 10 has a provisional fixing portion 12 for temporarily fixing the lock spring 40. The provisional fixing portion 12 has two upstanding walls 12*a* and 12*b* clamping the connecting portion 42 of the lock spring 40. The lock spring 40 is positioned on the mating side 11 in such a way that only a central portion of the connecting portion 42 has been temporarily fixed to the provisional fixing portion 12. Therefore, two arms 41 of the lock spring 40 are movable in a direction R-R shown in FIG. 3.

In the embodiment shown, the reinforcement fitting 50 is a metal member covering the lock spring 40 and clamping the lock spring 40 between the same and the housing 10. However, portions of the two arms 41 of the lock spring 40 are exposed from cutouts 52 of the reinforcement fitting 50, such that the lock spring 40 has been covered with the reinforcement fitting 50.

The reinforcement fitting 50 includes board fixing portions 51 at four portions thereof in the embodiment shown. The board fixing portions 51 are soldered to the circuit board (not shown) together with the solder portions 21 of the contacts 20. The reinforcement fitting 50 further includes press-fitting portions 53 press-fitted with the housing 10. Using the board fixing portions 51 and the press-fitting portions 53, the first connector 1 is secured to the circuit board and the lock spring 40 is prevented from falling off from the housing 10. While the reinforcement fitting 50 prevents the lock spring 40 from movement that is perpendicular to the mating side 11 of the housing 10, the lock spring 40 is movable in a direction parallel to the mating side 11. Therefore, the lock spring 40 is movable in the direction of arrow R-R even when it has been covered with the reinforcement fitting 50. As a result, self-alignment is performed at a mating time with the second connector 2 described later. The self-alignment will be further described later.

Figure 4A:
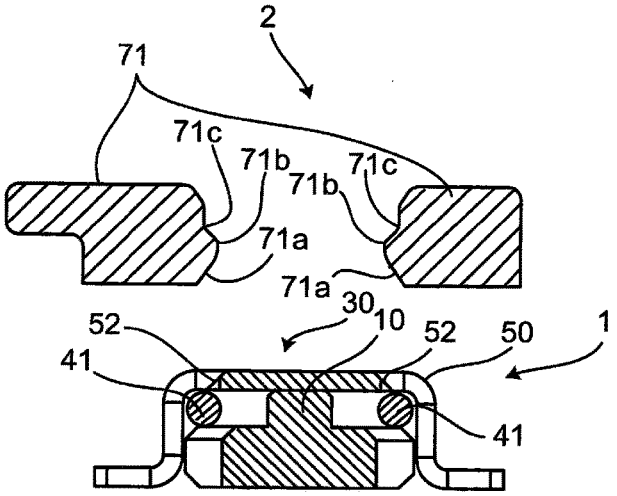
FIG. 4A is a sectional view of the lock of the first connector and a catch of the second connector

With respect to FIG. 4 A, cross sections of the lock portion 30 and the catch 71 of the metal shell 70 (see FIG. 1 and FIG. 2) are shown separately. In the lock portion 30, the two arms 41 of the lock spring 40 (see FIG. 3) have been clamped between the housing 10 and the reinforcement fitting 50 is shown. However, as described above, the two arms 41 are in a state where they have been partially exposed from the cutouts 52 of the reinforcement fitting 50.

The catch 71 of the metal shell 70 (see FIG. 1 and FIG. 2) of the second connector 2 includes a slop 71*a* with a shape opened toward the first connector 1, a projecting top portion 71*b* continued from the slope 71*a*, and a recessed portion 71*c* with a slightly recessed shape continues from the top portion 71*b*.

Figure 4B:
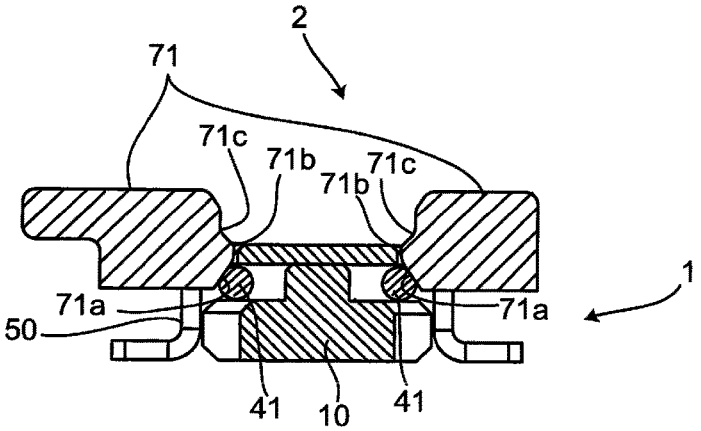
FIG. 4B is another sectional view of the lock of the first connector and the catch of the second connector

When the second connector 2 is brought close to the first connector 1, the catches 71 enter the cutouts 52 (see FIG. 3) to interfere with the two arms 41. As shown in FIG. 4B, the lock spring 40 is elastically deformed so as to bring the two arms 41 close to each other by the slopes 71*a*.

Figure 4C:
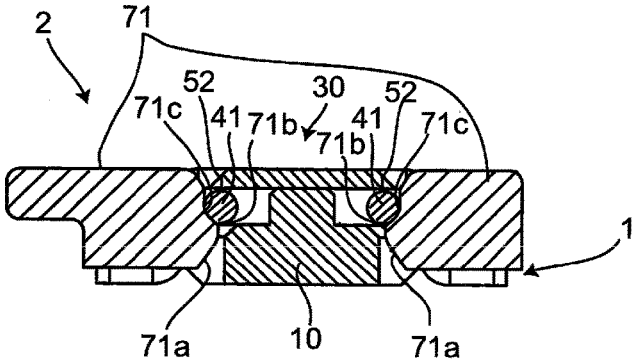
FIG. 4C is another sectional view of the lock of the first connector and the catch of the second connector.

When the second connector 2 is further urged to the first connector 1 so that the top portions 71*b* of the catches 71 pass through the two arms 41, as shown in FIG. 4C, the two arms 41 are restored from elastic deformation to enter the recessed portions 71*c*. As described above, the two arms 41 are movable in the direction of arrow R-R shown in FIG. 3. Therefore, when the two arms 41 interfere with the catches 71 to be elastically deformed, the two arms 41 are pressed by the catches 71 such that the two arms 41 are deformed evenly, so that alignment is automatically performed in the direction of arrow R-R.

The lock portions 30 1 and the catches 71 are provided at both end portions of the first connector 1 and the second connector 2, respectively. Therefore, catching or engagement shown in FIG. 4 is performed at both end portions of the first connector 1 and the second connector 2, so that the second connector 2 is caught on the first connector 1.

As shown in FIG. 4C, the lock mechanism is suitable for height reduction such that catching is performed in the same thickness as the thickness of the first connector 1. Further, when the second connector 2 is unmated from the first connector 1, connection with the first connector 1 is released by strongly pulling the second connector 2 upward. Since the lock spring 40 is firmly fixed by the reinforcement fitting 50, the lock spring 40 is not detached from the first connector 1 by the releasing action and it is possible to mate and un-mate with the second connector 2 from the first connector 1 repeatedly.

It should be noted that the described lock structure includes two arms 41 having an approximate U-shaped lock spring 40 that is elastically deformable in such a way that it can be brought close to each other by the catches 71 of the metal shell 70 of the second connector 2. However, this is just an exemplary embodiment of the invention. In fact, shapes of the reinforcement fitting 50, the catches 71 and/or the like may be changed and the catches of the second connector 2 may be received between the two arms 41 to elastically deform the two arms 41 so as to separate from each other and then the arms 41 are restored according to elastic deformation thereof, so that catching is performed.

With respect to FIGS. 5A and 5B, other embodiment of the lock spring will be described.

As described above, the lock spring 40 has an approximate U shape and includes two arms 41 and a connecting portion 42 connecting these two arms 41. It should be noted that the lock spring in the present invention is only required to be formed of one wire material having two arms and the lock spring is not required to have the U shape necessarily.

Figure 5A:
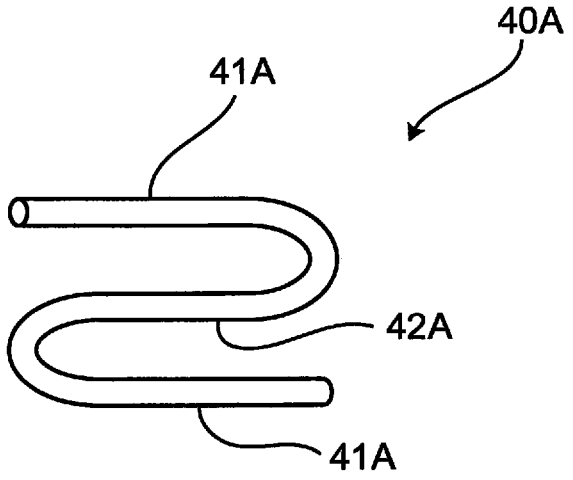
FIG. 5A is a perspective view of a lock spring according to the invention.

As shown in FIG. 5A, a lock spring 40A is shown. The lock spring 40A is also formed of a single wire of material and includes two arms 41A extending approximately in parallel to each other like the lock spring 40 of the above described embodiment. However, a connecting portion 42A connects end portions of the two arms 41A which are positioned on the sides separated from each other to form an approximately-S shaped lock spring.

Figure 5B:
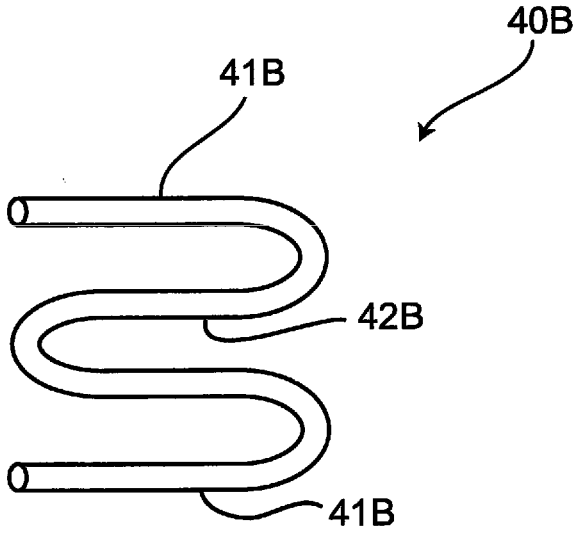
FIG. 5B is a perspective view of a lock spring according to the invention.

In FIG. 5*b*, another lock spring 40B is shown.

The lock spring 40B is formed from a single wire of material and includes two arms 41B extending approximately in parallel to each other like the lock spring 40 of the above described embodiment. However, a connecting portion 42B has an approximately U shape itself to form an approximately W-shaped lock spring 40B.

When the lock springs 40A and 40B of these modified examples are adopted, the shapes of the housing 10 and the like must be modified, but it is possible to realize a connector assembly functioning in a manner similar to that of the above embodiment.

Further, the second connector 2 is not limited to the FPC 60 but it may be a connector where contacts and catches have been secured to a housing.

The foregoing illustrates some of the possibilities for practicing the invention. Many other embodiments are possible and within the scope and spirit of the invention. It is, therefore, intended that the foregoing description be regarded as illustrative rather than limiting, and that the scope of the invention is given by the appended claims together with their full range of equivalents.

What is claimed is:

1. A connector assembly comprising:

a first connector having a housing, and a plurality of separate lock springs, wherein each lock spring is formed of a single wire of material with a circular cross section and has a pair of arms extending parallel to a planar side of the housing with one of the lock springs arranged at one end portion of the housing and another of the lock springs arranged at another end portion of the housing, and a plurality of reinforcement fittings, each reinforcement fitting covering one of the lock springs and including a cutout to expose a portion of the arms; and a second connector having a catch to engage the lock spring by flexing the pair of arms toward each other.

2. The connector assembly according to claim 1, wherein the pair of arms extend approximately parallel to each other.

3. The connector assembly according to claim 2, wherein the lock spring is u-shaped.

4. The connector assembly according to claim 2, wherein the lock spring is S shaped.

5. The connector assembly according to claim 2, wherein ends of the pair of arms extending parallel to each other and in the same direction.

6. The connector assembly according to claim 5, further comprising a U shaped connection portion connecting the pair of arms.

7. The connector assembly according to claim 6, wherein the lock spring is w shaped.

8. The connector assembly according to claim 1, wherein the pair of arms is elastically deformable.

9. The connector assembly according to claim 1, wherein the reinforcement fitting further includes board fixing portions positioned along four portions thereof.

10. The connector assembly according to claim 9, wherein the reinforcement fitting further includes press-fitting portions press-fitted with the housing.

11. The connector assembly according to claim 1, wherein the second connector includes a flexible printed circuit board having a conductor pattern in contact with the first connector.

12. The connector assembly according to claim 11, wherein the second connector further includes a metal shell secured to the flexible printed circuit board and having a plurality of catches.

13. The connector assembly according to claim 12, wherein the plurality of catches fasten with the lock spring by flexing the pair of arms.

14. A connector assembly comprising:

a first connector having:

(a) a housing, and (b) a plurality of separate U-shaped lock springs:

(1) each disposed at an end portion of the housing and another end portion of the housing, (2) formed of a single wire of material with a circular cross section, and (3) having a curved portion between a pair of arms that extend parallel to planar sides of the housing, and (c) a plurality of reinforcement fittings:

(1) each covers one of the lock springs, and (2) each includes a cutout to expose a portion of the arms of the lock springs; and a second connector having:

a catch engaging the arms of the lock spring and flexing the pair of arms of the lock spring toward each other.

15. The connector assembly according to claim 1, wherein the pair of arms extend away from the housing.

* * * * *